United States Patent [19]

Carroll et al.

[11] 4,189,052

[45] Feb. 19, 1980

[54] STACK AND NEST CONTAINER

[75] Inventors: James C. Carroll; Lewis T. Johnson, both of Hopkinsville, Ky.

[73] Assignee: Phillips Petroleum Company, Bartlesville, Okla.

[21] Appl. No.: 892,795

[22] Filed: Apr. 3, 1978

[51] Int. Cl.[2] ..... B65D 21/04

[52] U.S. Cl. ..... 206/507

[58] Field of Search ..... 206/505, 506, 507

[56] References Cited

U.S. PATENT DOCUMENTS

| | | | |
|---|---|---|---|
| 3,773,213 | 11/1973 | Frederick | 206/507 |
| 3,934,724 | 1/1976 | Johnson | 206/507 |
| 3,951,265 | 4/1976 | Carroll | 206/506 |
| 4,023,680 | 5/1977 | Thurman | 206/507 |

*Primary Examiner*—George E. Lowrance

[57] ABSTRACT

A container adapted to stack upon the endwalls of an identically oriented identical container, to partially nest within the endwalls of a reversely oriented identical container, and to have improved ability to resist the outward flexing of the endwalls that tends to occur due to the weight resting upon a container which is partially nested in the inventive container.

10 Claims, 15 Drawing Figures

STACK AND NEST CONTAINER

This invention relates to a stack and partial nest container.

Stack and partial nest containers are known in the art. In general such containers are constructed so that an upper container will stack on or partially nest within a like lower container depending upon the orientation of the upper container with respect to the lower container.

Such stack and partial nest containers are particularly useful, for example, in the storage and transportation of bakery products where it is often desirable to handle trays containing a single layer of a dense product of relatively low dimensions, such as small pound cakes, etc., as well as trays containing several layers less dense materials, such as bread loaves, etc.

The partial stacking feature allows one to stack a tray upon a partially filled tray in a lower position thus with a suitably constructed stack and partial nest container it is possible using the one type of container to stack completely filled and partially filled containers in a much smaller area.

This adds up to a savings in both transportation and storage costs.

It has been noted that when one has, for example, about 16 to 18 loaded trays stacked one upon the other considerable stress is often exerted on the endwalls of the lower containers. This is particularly so where the trays have sidewalls lower than the endwalls or no sidewalls at all. In many cases this stress leads to a lessening of the useful life of the containers.

An object of the present invention is to provide a stack and partial nest container constructed such that when it contains another like container in the partial nest position its endwalls will have much greater resistance to outward flexing than prior art stack and partial nest containers similarly nested.

Another object of an embodiment of the present invention is to provide a stack and partial nest container constructed such that when it has another compatible container stacked thereon parts of the inventive container will serve to inhibit shifting of the upper container from sidewall to sidewall relative to the inventive lower container.

Still another object of an embodiment of the present invention is to provide a stack and partial nest container constructed such that when it has another compatible container partially nested therein parts of the inventive container will serve to inhibit shifting of the upper container from sidewall to sidewall relative to the lower container.

Other objects and advantages of the present invention will become apparent from the following disclosure and the accompanying drawings.

In accordance with the present invention there is provided a stack and partial nest container comprising a generally horizontally disposed generally rectangular bottom and opposed first and second endwalls projecting upwardly from first and second opposed ends of said bottom. The first and second endwalls comprises a plurality of spaced apart generally vertical columns. The columns and spaces therebetween in one of said first and second opposed endwalls are arranged with respect to columns and spacing therebetween of the other of said first and second endwalls so that another like container, when reversely oriented with respect to said container, will fit inside said container in a partial nest position, i.e., in a position somewhere between the stacked position and the completely nested position where the bottom of the upper container rests upon the upper surface of the bottom of the lower container. Further at least two columns on each endwall each contain on upper surfaces thereof a stacking post and on lower surface thereof a stacking foot adapted such that when said container is stacked upon another identically oriented identical container the stacking foot of the upper container will fit over the outer surface of the stacking post of the corresponding column of the lower container such that said stacking posts of said lower container and said stacking feet of said upper containers cooperate to limit any outward flexing of the endwalls of the lower container due to weight resting upon the upper container.

Each endwall of said container further comprises at least two nesting posts and at least two nesting feet located in the spaces between said columns in such a manner that when an identical container is rotated 180 degrees and partially nested therein a stacking foot of the upper container will fit over the outer surface of each nesting post of the lower container such that said stacking feet and said nesting posts cooperate to limit outward flexing of the endwalls of the lower container and each partial nesting foot of the upper container will fit over the outer surface a stacking post of the lower container such that said stacking foot and said nesting posts cooperate to limit outward flexing of the endwalls of the lower container due to weight resting upon the upper container.

In the preferred embodiments of the instant invention there are stacking posts and stacking feet on each column of the endwalls and nesting posts and nesting feet in the space beside each column.

In another preferred embodiment of the present invention one column on each endwall contains a first stabilizer post adapted for contact with one side of the lower end of the corresponding column of an identically oriented identical container stacked thereon so as to inhibit shifting of the upper tray from sidewall to sidewall relative to the lower inventive tray.

In yet another preferred embodiment of the present invention each endwall also includes a second stabilizer post adapted for contact with one side of one of the columns of a reversely oriented identical container partially nested therein so as to inhibit shifting of the upper container from sidewall to sidewall relative to the lower inventive tray.

In yet still another preferred embodiment of the present invention the first stabilizer post of each endwall of the inventive container is also adapted for contact with the side of said endwall that is opposite said second stabilizer post of a reversely oriented identical container partially nested therein so as to assist said second stabilizer post of said inventive container in inhibiting shifting of the upper container from sidewall to sidewall relative to the lower inventive tray.

In still another embodiment the at least one stacking post and at least one stacking foot on each endwall is constructed such that when two such containers are placed in the stacked position said stacking post of the lower container and said stacking foot of the upper container cooperate to limit the extent that the upper container can shift from sidewall to sidewall relative to the lower container.

In yet another embodiment the endwalls are constructed such that when such a container is placed in an identical container in the partial nest position at least one nesting foot of the upper tray and at least one stacking post of the lower tray of each endwall and at least one nesting post and at least one stacking foot of each endwall cooperate to limit the extent that the upper container can shift from sidewall to sidewall relative to the lower container.

In addition to the first and second endwalls, the container of this invention can, and preferably does, contain one or two sidewalls each extending upwardly from a respective one of the other two opposed sides of the bottom of the container. The only requirement on the construction of these additional sidewalls is that they not prevent the stacking and partial nesting capability provided by the endwalls as described above.

In an especially preferred embodiment of the present invention the container contains two opposed sidewalls which allow one to nest such container upon the sidewalls of a lower such container oriented 90° relative thereto. Preferably, in such an embodiment the two opposed sidewalls permit a second container to nest within the first container sufficiently far enough that when a third container oriented the same as the lowermost container is placed upon the second container it will stack upon the first, i.e., lowermost, container as though the second container were not even present. By using the 90° nesting one can stack a given number of empty trays in considerably less space than required for stacks formed by nesting the trays by using the 180° nesting provision. The 90° nesting feature also allows one to stack the empty trays in only slightly more than one-half of the space required for a stack of trays in which each tray is in the fully stacked position.

The container of the present invention may be made of any suitable material, preferably the tray is made of the plastics conventionally used in making bakery trays and the like. Preferably the container is molded from a single homogenous mass of thermoplastic material such as high density polyethylene.

The bottom of the present container can be of any suitable form. While the bottom can comprise a solid plane sheet of material it is preferred that the bottom contain perforations. In an especially preferred embodiment the bottom comprises a gridwork of the type generally employed in bakery trays and the like.

For further understanding of the present invention reference can be made to the accompanying drawings, wherein.

In the accompanying Figures like reference numerals are employed to denote like elements.

Figure 1:
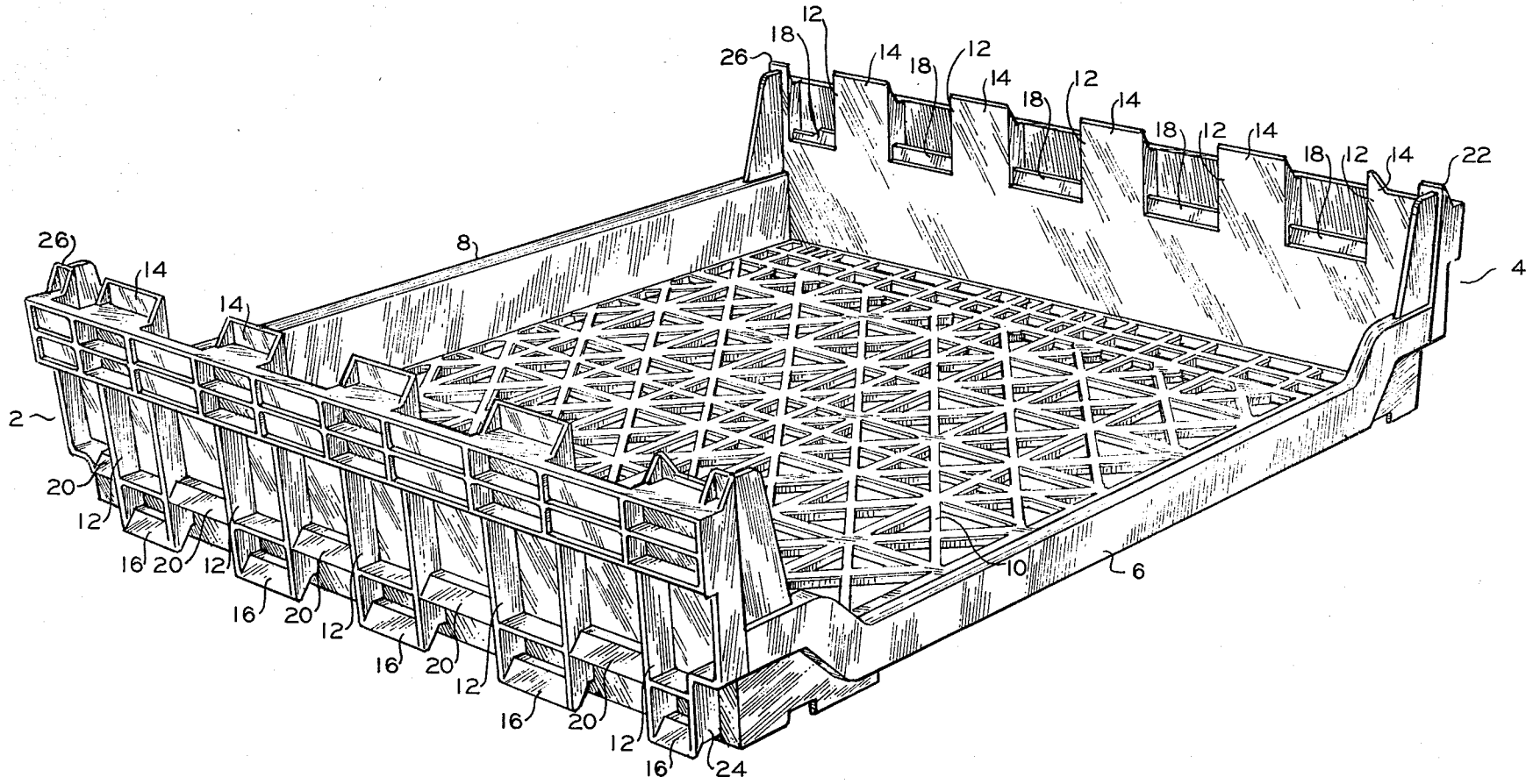
FIG. 1, is a top perspective view of a specific bakery tray which is a presently preferred embodiment of this invention.
Figure 2:
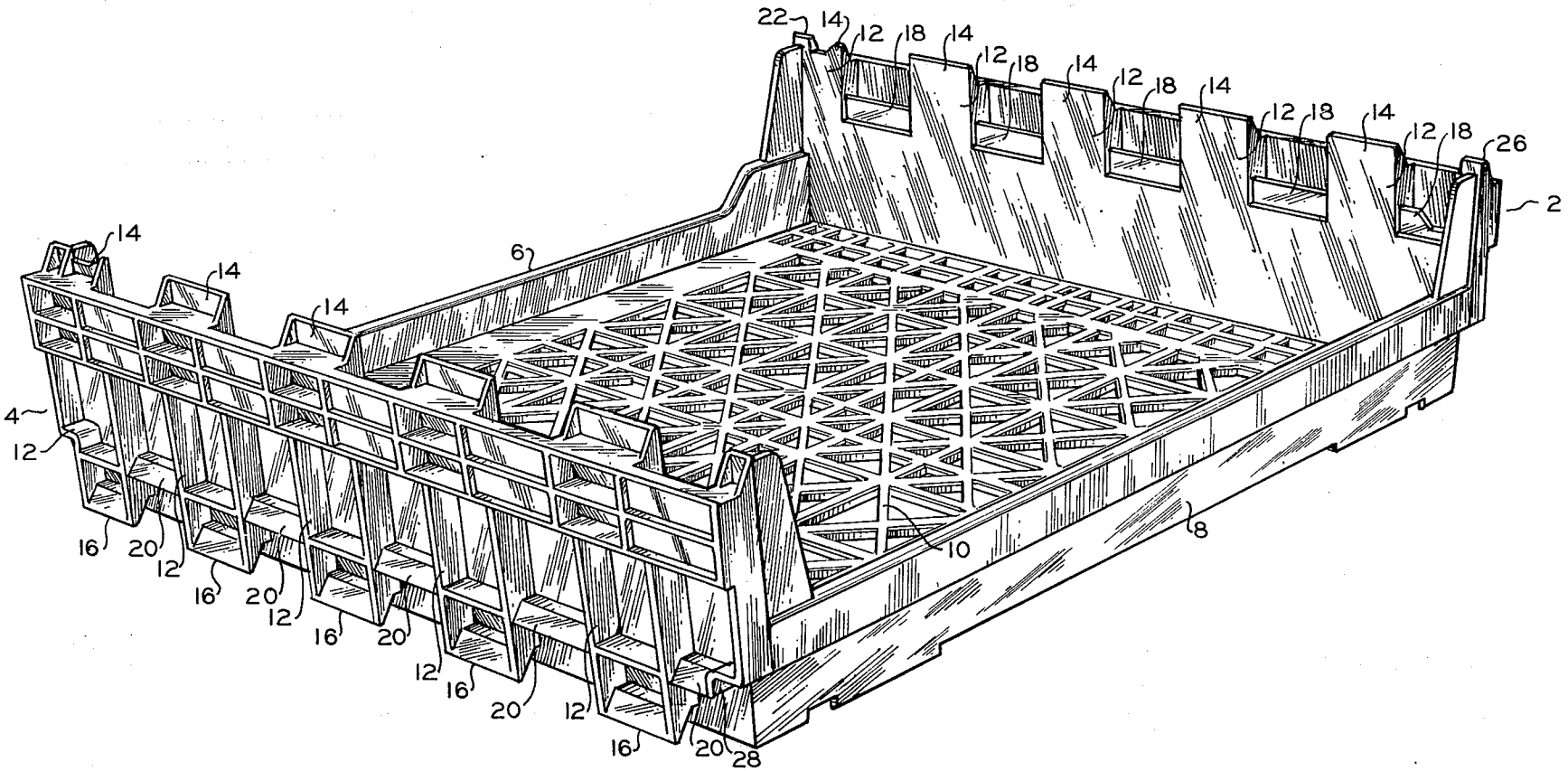
FIG. 2, is a top perspective of the tray of FIG. 1 rotated 180° from the position shown in FIG. 1.
Figure 3:
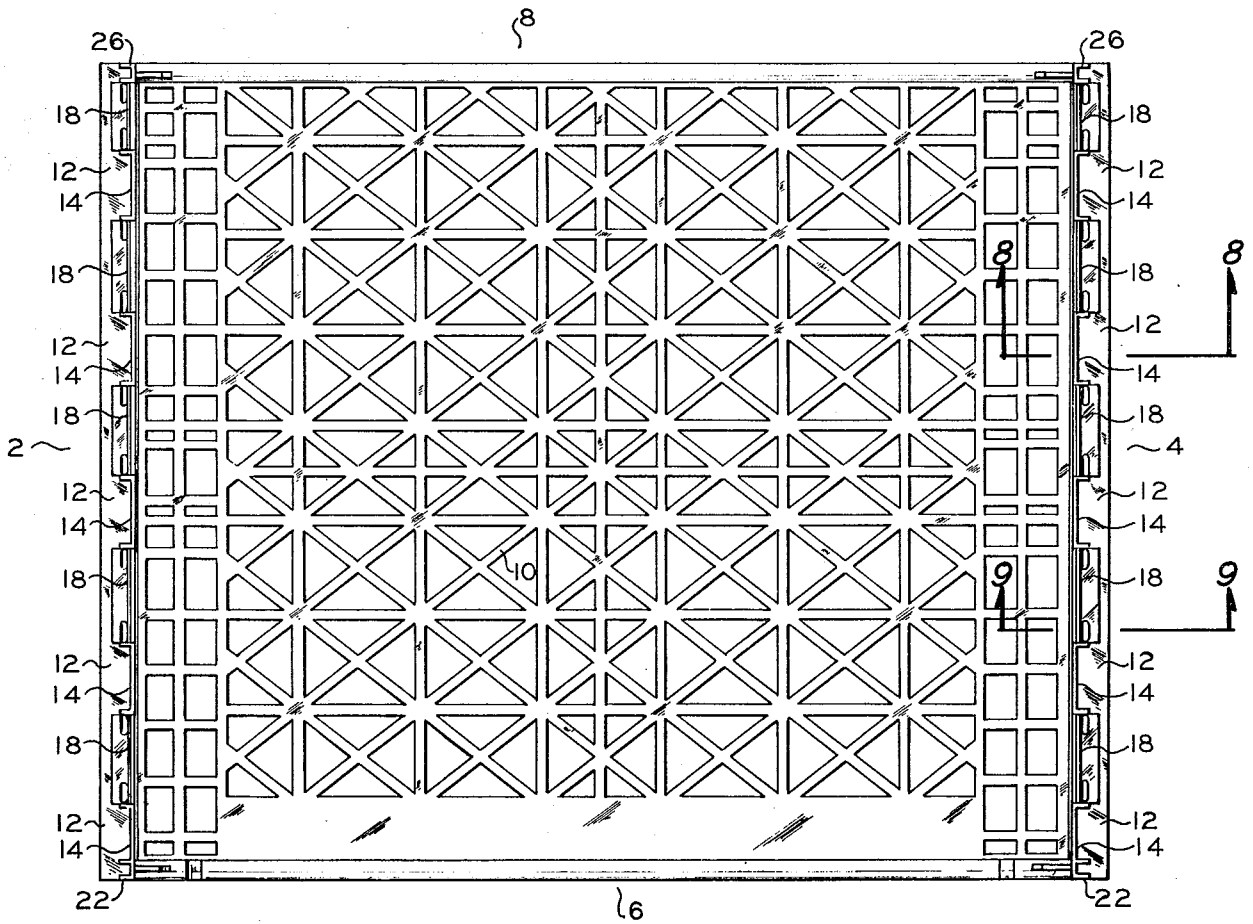
FIG. 3, is a top plan view of the tray of FIG. 1.
Figure 4:
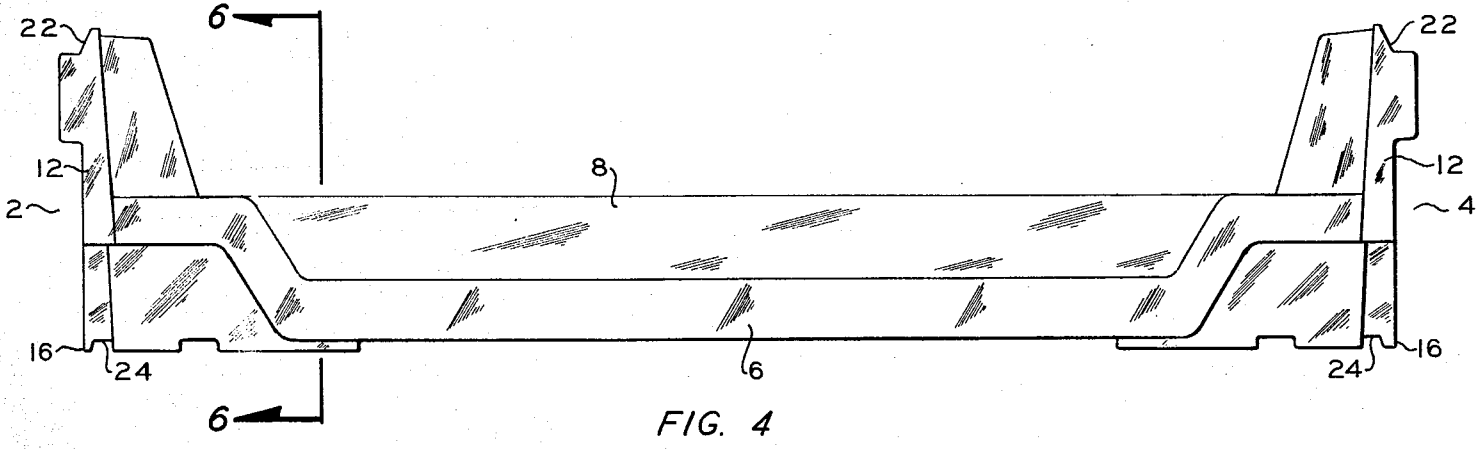
FIG. 4, is a side elevation view of the one sidewall of the tray of FIG. 1.
Figure 5:
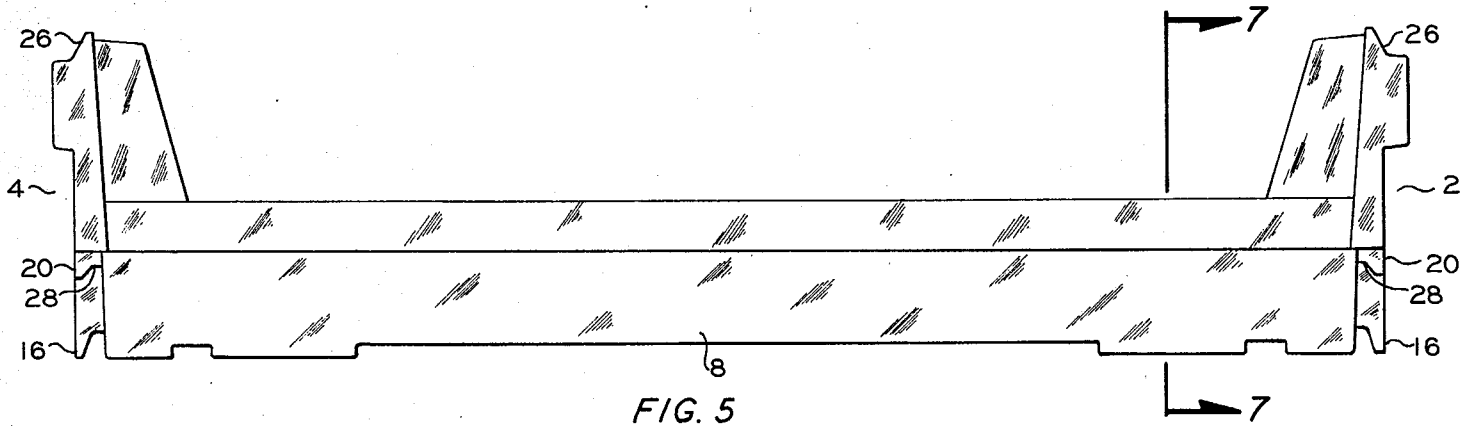
FIG. 5, is a side elevation view of the other sidewall of the tray of FIG. 1.

The container illustrated in FIG. 1 is a generally rectangular container having two opposed endwalls 2 and 4, a sidewall 6, and a sidewall 8, extending upward from respective sides of a generally rectangular bottom 10. In the embodiment illustrated the bottom 10 comprises a gridwork. The sidewall 6 and the sidewall 8 are constructed so as to permit one to nest on such container inside another such container oriented 180° relative thereto.

Each of the endwalls 2 and 4 comprises five spaced apart generally vertical columns 12. The columns 12 and the spaces therebetween in endwall 2 are arranged with respect to the columns and spaces therebetween of endwall 4 so that another like container, when reversely oriented with respect to said container, will fit inside said container in a partial nest position. This is achieved in the container illustrated by placing the respective columns and spaces of each endwall 2 and 4 directly opposite each other.

Figure 9:
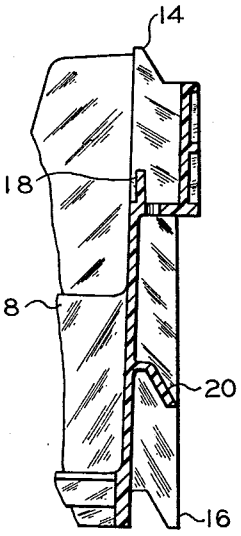
FIG. 9 is a cross-sectional view taken along line 9—9 of FIG. 3.
Figure 8:
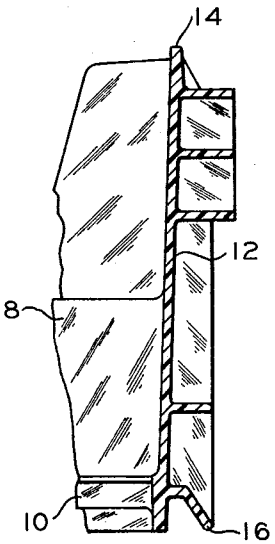
FIG. 8 is a cross-sectional view taken along line 8—8 of FIG. 3.
Figure 7:
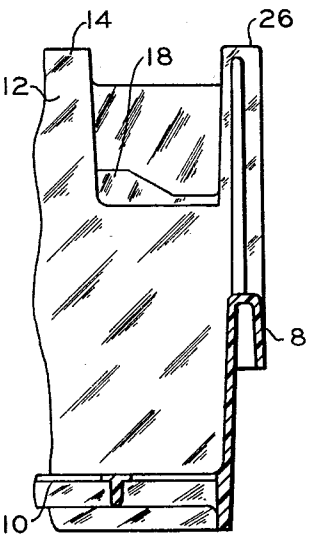
FIG. 7 is a cross-sectional view taken along line 7—7 of FIG. 5.
Figure 6:
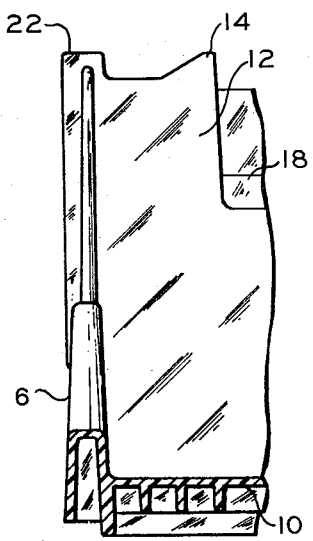
FIG. 6, is a cross-sectional view taken along line 6—6 of FIG. 4.
Figure 10:
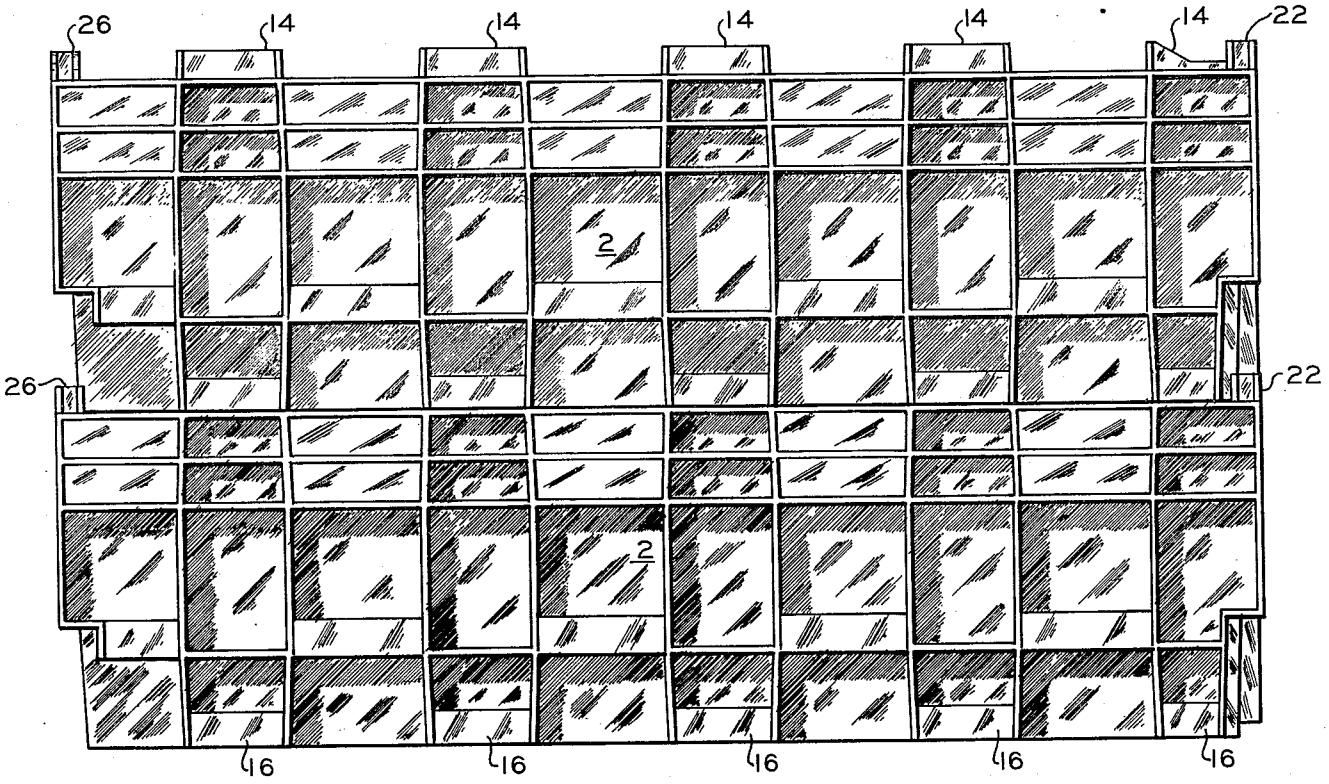
FIG. 10 is an end elevation view showing two trays of the type shown in FIG. 1 in the identially oriented stack relationship.
Figure 11:
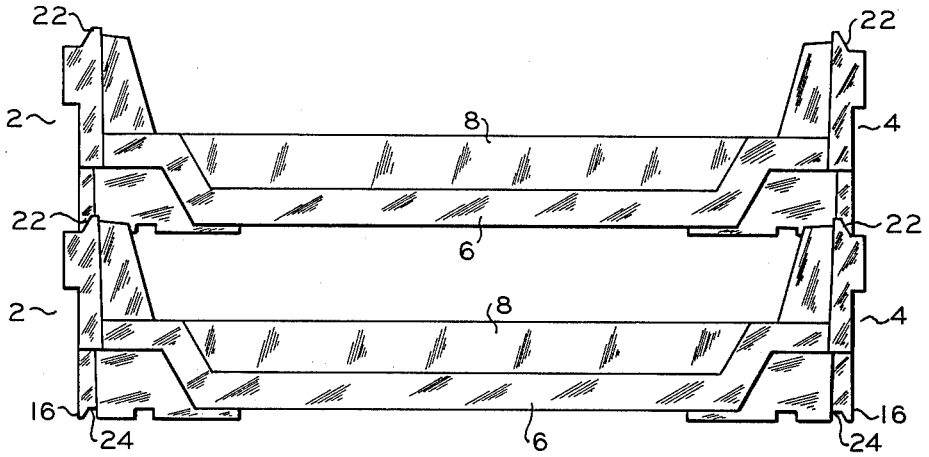
FIG. 11 is a side elevation view showing two trays of the type shown in FIG. 1 in the identically oriented stacked relationship.

Each column 12 of each endwall 2 and 4 of the container has upon its upper surface a stacking post 14 and on its lower surface a stacking foot 16. The stacking foot 16 is adapted to fit down the outer surface of the stacking post 14 of a corresponding column of another identically oriented identical container upon which said container is stacked, in such a manner that each such stacking post of the lower container and each said stacking foot of the upper container cooperate to limit any outward flexing of the endwalls of the lower container due to weight resting upon the upper container. The structure of the stacking posts 14 and the stacking feet is more clearly seen in FIGS. 8 and 9 which illustrate cross-sectional views of one endwall of the container of FIG. 1. FIGS. 10 and 11 illustrate how two such containers stack in the manner just described.

Figure 12:
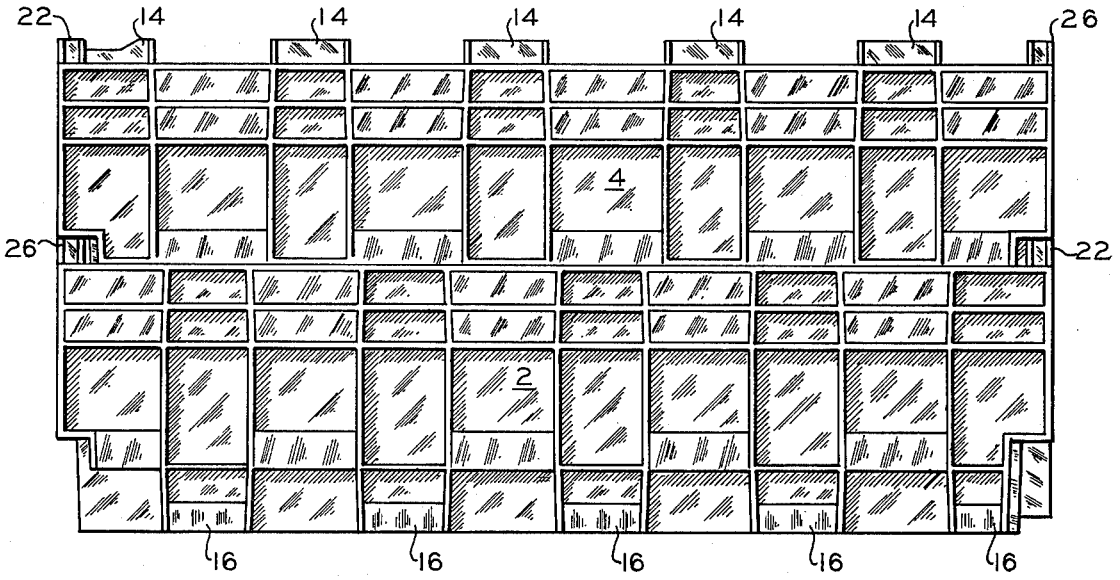
FIG. 12 is an end elevation view showing two trays of the type shown in FIG. 1 oriented 180° relative to each other in the partial nested relationship.
Figure 13:
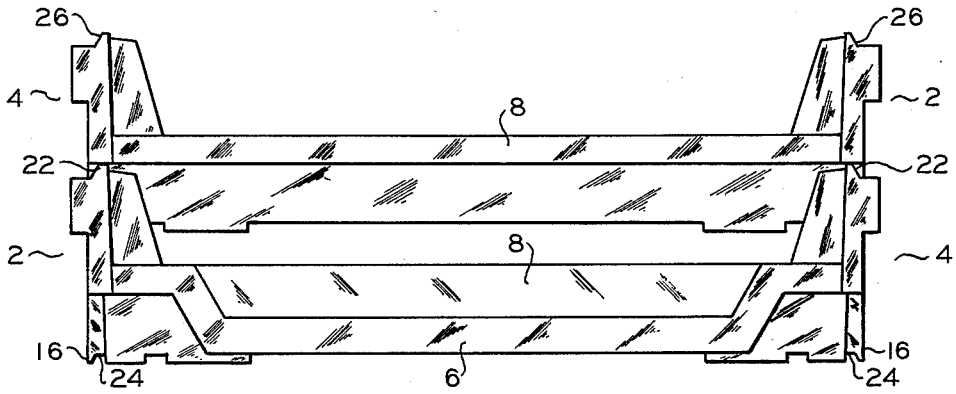
FIG. 13 is a side elevation view showing two trays of the type in FIG. 1 oriented 180° relative to each other in the partial nested relationship.

In the space beside each column 12 there is located a nesting post 18 above a respective nesting foot 20. The respective nesting posts 18 are located such that when such a container is rotated 180° relative to an identical lower container and partially nested within such lower container each stacking foot 16 of the upper container will fit over the outer surface of each nesting post 18 of the lower container such that the stacking feet 16 and the nesting posts 18 cooperate to limit any outward flexing of the endwalls of the lower container. Further, the respective nesting feet 20 are located such that when an identical container is rotated 180° and partially nested within such a container each nesting foot 20 will fit over the outer surface of each stacking post 14 such that the nesting feet 20 and the stacking posts 14 cooperate to limit any outward flexing of the endwalls of the lower container. This unique endwall construction thus provides for a double lock which provides the lower containers with superior resistance toward having its endwalls flexed outward due to weight resting upon the container nested therein. The structure of the nesting posts and the nesting feet can be seen most clearly in FIG. 9. FIGS. 12 and 13 illustrate how two such containers nest in the manner just described.

In the illustrated container the column 12 of each endwall that is adjacent the sidewall 6 is narrower at the bottom than at the top. Each of those two columns also include on its upper surface a stabilizer post 22. The upper surface of the stacking post 14 of each of those columns is lower on the side adjacent the stabilizer post 22. This low portion of the stacking post 14 extends about half the width of the stacking post. The remainder of the upper surface inclines upwardly to a point of height equal to that of the upper surface of the other stacking posts. On the stacking foot 16 of each of those two columns on the side of said stacking foot adjacent the sidewall 6 there is a downwardly projecting web 24. The web 24 extends downwardly such that when two such containers are stacked upon one another the web 24 of the upper container will rest above the lower part of the upper surface of stacking post 14 of the lower container and will extend below the upper part of the upper surface of that stacking post such that the web 24 and the upper part of the upper surface of the stacking post will limit the distance that the upper container in such a stack can be pushed in the direction toward the sidewall 8. The stabilizer post 22 is positioned such that it can contact the web 24 to limit the distance that the upper container in such a stack can be pushed in the direction toward the sidewall 6.

It will also be noted that the nesting posts 18 adjacent the sidewall 8 has high and low areas on its upper surface in conformity with those of the stacking post of the column adjacent the sidewall 6. Thus when two such containers are placed in the partial nesting position the webs 24 of the columns of the upper containers will cooperate with the upper portion of those nesting posts to limit the extent to which the upper container can be moved toward the sidewall 6 of the lower container.

Further each endwall of the container has a second stabilizer post 26 adjacent to sidewall 8. The stabilizer posts 26 are positioned such that when an identical container is placed therein in the partially nested position the side of the column of the container that is adjacent the low sidewall of the upper container will abut the stabilizer posts 26.

Further in each endwall the nesting foot adjacent the sidewall 8 contains a downwardly depending web 28. This web is so constructed and positioned that when such a container is partially nested in an identical container the web portion 28 of the container rests above the lower portion of the upper surface of the stacking post of the column immediately below and will abut the stabilizer post 22 of that column. Thus in the nested position the stabilizer posts 22 of the lower container contact the web portion 28 of the upper container and the stabilizer posts 26 of the lower container contact the columns of the upper container that are adjacent the low sidewall such that the stabilizer posts 22 and 26 of the lower container prevent the upper container from shifting from side to side within the lower container.

Figure 14:
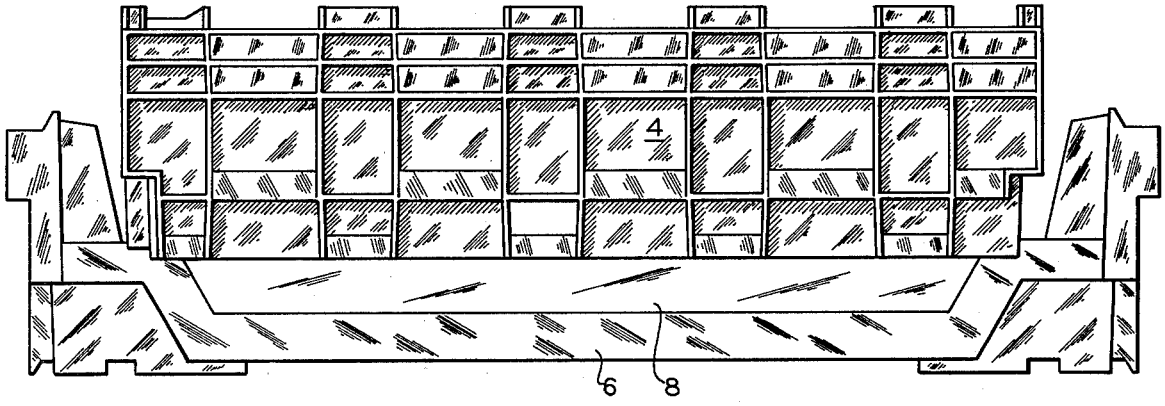
FIG. 14 is a end elevation view of a tray as shown in FIG. 1 containing an idential tray in the 90° nesting relationship.
Figure 15:
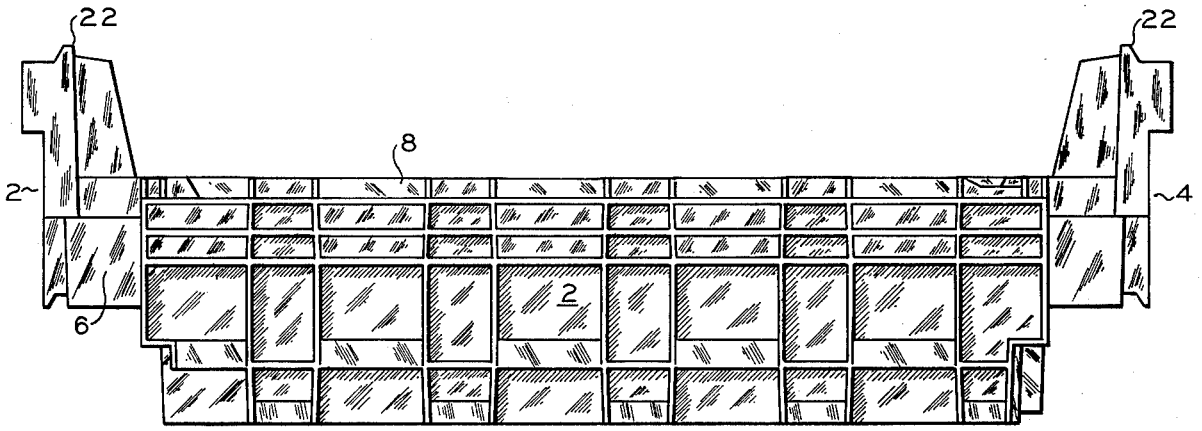
FIG. 15 is a side elevation view of a tray as shown in FIG. 1 containing an identical tray in the 90° nesting relationship.

In the container illustrated in FIG. 1 the sidewalls 6 and 8 are constructed such that an identical container when rotated 90° with respect to a lower such container can be rested upon the upper surface of the sidewalls of the lower container in a nested position. This feature is illustrated in FIGS. 14 and 15, the sidewalls 6 and 8 are sufficiently low that said thus nested container will not interfere with the stacking of a third container upon the first, i.e. the lowermost, container.

From the foregoing description, one skilled in the art can easily ascertain the essential characteristics of the invention and without departing from the spirit and scope thereof, can make various changes and modifications of the invention to adapt it to various usages and conditions. It is to be noted that the instant invention is not limited to the specific container shown in the Figures and discussed above. The illustration and discussion regarding the specific container is only a specific embodiment of the present invention which has been provided to more clearly illustrate the features of the instantly claimed invention.

What I claim is:

1. A generally rectangular container adapted for stacking and partially nesting with another like container comprising a generally horizontally disposed generally rectangular bottom and opposed first and second endwalls projecting upward from first and second opposed ends of said bottom, wherein said first and second endwalls each comprise a plurality of spaced apart generally vertical columns, wherein the columns and the spaces therebetween in one of said first and second opposed endwalls are arranged with respect to the columns and spaces therebetween of the other of said first and second endwalls so that another like container when reversely oriented with respect to said container, will fit inside said container in a partial nest position, and wherein at least two columns on each endwall each contain on the upper surface thereof a stacking post and on the lower surface thereof a stacking foot adapted such that when said container is stacked upon another identically oriented identical container the stacking foot of the upper container will fit over the outer surface of the stacking post of the corresponding column of the lower container such that said stacking posts of said lower container and said stacking feet of said upper container cooperate to limit outward flexing of the endwalls of the lower container due to weight resting upon the upper container, and wherein each endwall further comprises at least two nesting posts and at least two nesting feet located in the spaces between said columns of said endwalls in such a manner that when an identical container is reversely oriented and partially nested within said container a stacking foot of the upper container will fit over the outer surface of each nesting post of the lower container such that said stacking feet and said nesting posts cooperate to limit outward flexing of the endwalls of the lower container due to weight resting upon the upper container and each nesting foot of the upper container will fit over the outer surface of a stacking post of the lower container such that said stacking feet and said nesting posts cooperate to limit outward flexing of the endwalls of the lower container due to weight resting upon the upper container.

2. A container according to claim 1 wherein there is a stacking post and stacking foot on each column of each endwall and a nesting post and nesting foot in the space beside each column.

3. A container according to claim 2 having first and second opposed sidewalls each extending upwardly from a respective one of the two opposed sides of the bottom of said container, said sidewalls being constructed so as not to interfere with said partial nesting of such a container within another identical container.

4. A container according to claim 3 wherein at least one stacking post and at least one stacking foot on each endwall is constructed such that when two such containers are placed one upon the other in the stacked position said at least one stacking post of each endwall of the lower container and said at least one stacking foot of each endwall of the upper container will limit the extent that the upper container can shift from sidewall to sidewall relative to the lower container.

5. A container according to claim 4 wherein at least one stacking post and at least one nesting foot on each endwall and at least one nesting post and at least one stacking foot on each endwall are constructed such that when such a container is place in an identical container in the partial nest position said at least one nesting foot of each endwall of the upper container cooperates with said at least one stacking post of each endwall of the lower container and at least one stacking foot of each endwall of the upper container cooperates with said at least one nesting post of the lower container to limit the extent that the upper container can shift from sidewall to sidewall relative to the lower container.

6. A container according to claim 5 wherein said sidewalls are sufficiently lower than the endwalls that when an identical container oriented 90° with respect to said container is placed upon said sidewalls the respective sidewalls of said upper container will not prohibit still another container from being placed upon the lowermost container in the partial nest position.

7. A container according to claim 2 wherein at least one stacking post and at least one nesting foot on each endwall and at least one nesting post and at least one stacking foot on each endwall are constructed such that when such a container is placed in an identical container in the partial nest position said at least one nesting foot of each endwall of the upper container cooperates with said at least one stacking post of each endwall of the lower container and at least one stacking foot of each endwall of the upper container cooperates with said at least one nesting post of the lower container to limit the extent that the upper container can shift from sidewall to sidewall relative to the lower container.

8. A container according to claim 1 wherein there is a stacking post and a stacking foot on each column and wherein for each stacking post there is a corresponding nesting foot and for each stacking foot there is a corresponding nesting post, and said stacking posts, stacking feet, nesting posts, and nesting feet are positioned such that when an identical container is reversely oriented with respect to such a container and partially nested within said container each stacking foot of the upper container will fit over the outer surface of a corresponding nesting post of the lower container and each nesting foot of the upper container will fit over the outer surface of a corresponding stacking post of lower container.

9. A container according to claim 8 having first and second opposed sidewalls each extending upwardly from a respective one of the two opposed sides of said container, said sidewalls being constructed so as not to interfere with said reverse oriented partial nesting of such a container within another identical container.

10. A container according to claim 9 wherein said sidewalls are longer than said endwalls and are sufficiently lower than the endwalls that when another identical container oriented 90° with respect to said container is placed upon said sidewalls the respective sidewalls of said upper container will not prohibit another container from being stacked upon the lowermost container in identical orientation with the lowermost container.

* * * * *